US006286331B1

(12) United States Patent
Lee

(10) Patent No.: US 6,286,331 B1
(45) Date of Patent: Sep. 11, 2001

(54) EVAPORATION PLATE FOR ICE MAKING MACHINES

(75) Inventor: Illyong Lee, 102-1803, Dongah Mokryun Apt., #236-22, Bijeon-dong, Pyongtaek-si, Kyonggi-do (KR)

(73) Assignees: Kyung Jin Ice Cuber Co., Ltd.; Illyong Lee, both of Kyonggi-do (KR)

( * ) Notice: Subject to any disclaimer, the term of this patent is extended or adjusted under 35 U.S.C. 154(b) by 0 days.

(21) Appl. No.: 09/606,526

(22) Filed: Jun. 30, 2000

(30) Foreign Application Priority Data

Jul. 1, 1999 (KR) ..... 99-12750

(51) Int. Cl.[7] ..... F25C 23/12
(52) U.S. Cl. ..... 62/340; 62/515
(58) Field of Search ..... 62/66, 340, 356, 62/515, 516, 347; 24/457, 459, 113 MP; 29/281.5

(56) References Cited

U.S. PATENT DOCUMENTS 3,280,588 * 10/1966 Brindley ..... 62/340
4,608,960 * 9/1986 Hering ..... 165/168
5,193,357 * 3/1993 Kohl et al. ..... 62/515
5,897,108 * 4/1999 Gordon et al. ..... 269/50

* cited by examiner

*Primary Examiner*—William E. Tapolcai
*Assistant Examiner*—Mohammad M Ali
(74) *Attorney, Agent, or Firm*—Morrison & Foerster LLP

(57) ABSTRACT

An evaporation plate for ice making machines is disclosed. This evaporation plate has a desired serpentine evaporation passage formed by an integration of two panels into a single plate, thus being free from a conventional separate serpentine evaporation tube. This is, the evaporation plate is formed by an integration of an upper panel, having a desired refrigerant channel formed on the panel through a pressing process, with a flat lower panel through a thermocompression bonding process into a single plate having a desired refrigerant passage formed by the channel. Since the evaporation plate is free from a conventional separate evaporation tube, it improves heat conductivity of refrigerant to a desired high level and is almost completely free from leakage of refrigerant. This evaporation plate also has a simple construction, and so it is automatically produced in commercial quantity at low production cost. The evaporation plate is preferably used in a conventional ice making machine while being integrated with an ice making cell plate.

4 Claims, 5 Drawing Sheets

EVAPORATION PLATE FOR ICE MAKING MACHINES

BACKGROUND OF THE INVENTION

1. Field of the Invention

The present invention relates to an evaporation plate for ice making machines and, more particularly, to an improvement in the evaporation plate for ice making machines, disclosed in Korean Patent Application No. 97-21,415 applied by the inventor of this invention, to form a serpentine evaporation passage in an evaporation plate by integrating two channeled panels into a single plate different from a conventional evaporation plate having a separate serpentine evaporation tube welded to the top surface of the evaporation plate.

2. Description of the Prior Art

In recent years, the terrestrial air temperature has been gradually increased due to global warmth and results in a quick increase in the consumption of ice. Particularly, since some agricultural and marine products, such as vegetables, fishes and shellfishes, are very apt to be spoiled during their circulation, it is necessary to use ice with such products for preventing them from spoiling during the circulation. In addition, ice also has been typically used in hotels, restaurants, etc, for keeping freshness of foods for a necessary period of time and for cooling beverages. It is thus necessary to produce a very large quantity of ice so as to provide ice to such consumers every day.

Such commercial ice has been typically produced using ice making machines. As well known to those skilled in the art, such ice making machines use a refrigeration cycle in the same manner as that of conventional refrigeration systems, such as refrigerators, freezers and air conditioners. In such a conventional refrigeration system, refrigerant flows through a refrigeration cycle while losing or absorbing heat during heat exchanging processes with surrounding air as follows: In such a conventional refrigeration cycle, gas refrigerant output from an evaporation plate acting as an evaporator is compressed at a compressor to become high temperature and high pressure gas refrigerant and is fed to a condenser. The condenser condenses the gas refrigerant to make saturated liquid refrigerant and feeds the refrigerant to a liquid/gas heat exchanger. In the liquid/gas heat exchanger, the saturated liquid refrigerant loses heat through a heat exchanging process with low temperature and low pressure gas refrigerant, thus becoming saturated cold liquid refrigerant. This saturated cold liquid refrigerant is, thereafter, fed to a dry filter.

The above dry filter consists of a refrigerant inlet port, a refrigerant outlet port, and a filter body provided between the two ports while connecting the ports together. An iron net and cotton are set within the body at the front and rear portions of the body. An absorbent is set within the dry filter and removed moisture and impurities from the refrigerant. The cold liquid refrigerant output from the dry filter, thereafter, passes through both a capillary tube and an expansion valve. The liquid refrigerant becomes expanded refrigerant having low temperature and low pressure. The refrigerant is, thereafter, fed into the evaporation plate to absorb heat from water filled in an ice making cell plate positioned around the evaporation plate, thus making desired ice cubes. The refrigerant is, thereafter, returned to the compressor to repeat the above-mentioned refrigeration cycle. The present invention particularly relates to such an evaporation plate acting as an evaporator of the above-mentioned evaporation system.

FIGS. 1*a* and 1*b* are perspective views, showing a conventional evaporation plate for ice making machines, with a separate serpentine refrigerant tube welded to the top surface of the evaporation plate into a single structure. As shown in the drawings, the conventional evaporation plate 30 has a separate serpentine evaporation tube 20 welded to the top surface of the plate 30. That is, the evaporation plate 30 comprises a flat panel covering the top of an ice making cell plate 10 having a plurality of cells 5. The separate serpentine evaporation tube 20 is firmly welded to the top surface of the flat panel covering the top of the cell plate 10.

However, such a conventional evaporation plate 30 is problematic in that the separate serpentine evaporation tube 20 is firmly welded to the top surface of the flat panel covering the top of the cell plate 10, and so the evaporation tube 20 spoils the appearance of the evaporation plate 30. In addition, it is very difficult to repeatedly and precisely bend the evaporation tube 20 to form a desired serpentine shape having a plurality of U-shaped portions, thus being reduced in work efficiency and productivity while producing evaporation plates 30. The serpentine evaporation tube 20 may be also weakened in its structural strength at the U-shaped portions and may be thermally weakened at the welded portions, thus sometimes causing undesirable leakage of refrigerant from the tube 20.

The separate serpentine evaporation tube 20, welded to the top wall of the evaporation plate 30 while projecting upward from the top wall, undesirably reduces heat conductivity of the refrigerant and is apt to be easily damaged or broken due to external impact. In addition, since the evaporation tube 20 has to be mounted to the top wall of the evaporation plate 30 through a welding process, it is very difficult to integrate the evaporation tube 20 with the evaporation plate 30 into a desired single structure. Another problem of the conventional evaporation plate 30 resides in that the evaporation tube 20 is regrettably somewhat spaced from the top wall of the evaporation plate 30 even though they are welded together into a single structure. This further reduces heat conductivity of the refrigerant.

SUMMARY OF THE INVENTION

Accordingly, the present invention has been made keeping in mind the above problems occurring in the prior art, and an object of the present invention is to provide an evaporation plate for ice making machines, which has a serpentine evaporation passage formed by an integration of two pressed and channeled panels into a single plate, thus being free from a separate serpentine evaporation tube welded to the top surface of a conventional evaporation plate and improving heat conductivity of refrigerant to a desired high level.

In order to accomplish the above object, the preferred embodiment of the present invention provides an evaporation plate for ice making machines, comprising an upper panel having a desired refrigerant channel formed on the panel through a pressing process, and a flat lower panel free from any refrigerant channel, the lower panel being integrated with the upper panel through a compression bonding process into a single plate having a desired refrigerant passage therein.

Since the evaporation plate for ice making machines according to this invention is thus free from a separate serpentine evaporation tube, the evaporation plate has a simple construction and is automatically produced in commercial quantity, and improves heat conductivity of refrigerant to a desired high level.

BRIEF DESCRIPTION OF THE DRAWINGS

The above and other objects, features and other advantageous of the present invention will be more clearly understood from the following detailed description taken in conjunction with the accompanying drawings, in which.

DETAILED DESCRIPTION OF THE INVENTION

Figure 1A:
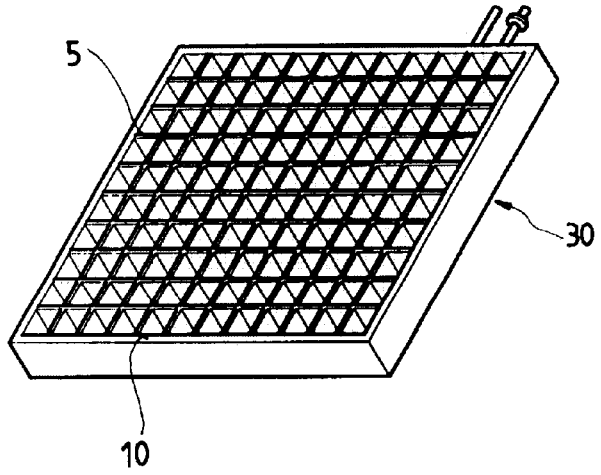
Fig. 1a (Prior Art)
FIGS. 1*a* and 1*b* are perspective views, showing a conventional evaporation plate for ice making machines, with a separate serpentine refrigerant tube welded to the top surface of the evaporation plate into a single structure.
Figure 1B:
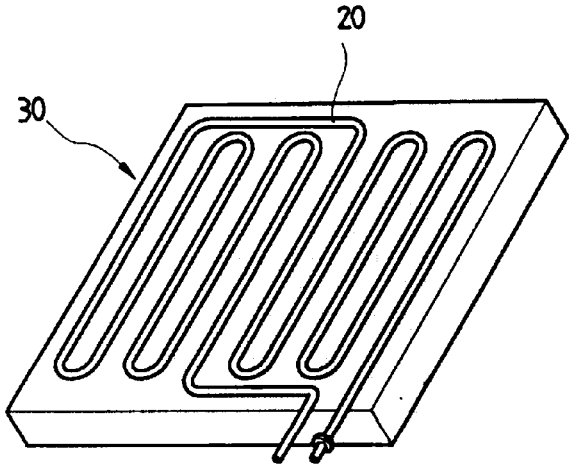
Fig. 1b (Prior Art)
Figure 2A:
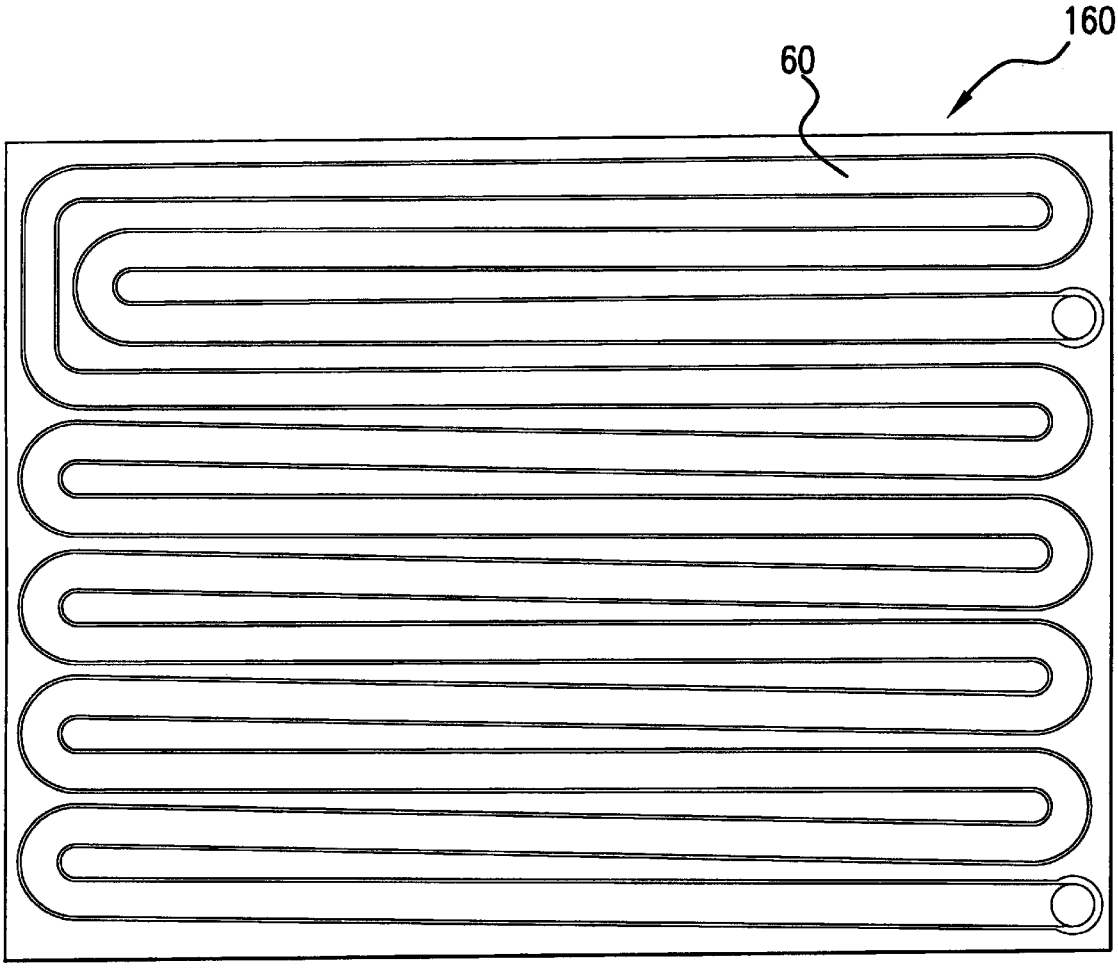
FIG. 2*a* is a plan view of an evaporation plate for ice making machines in accordance with the primary embodiment of the present invention.
Figure 2B:
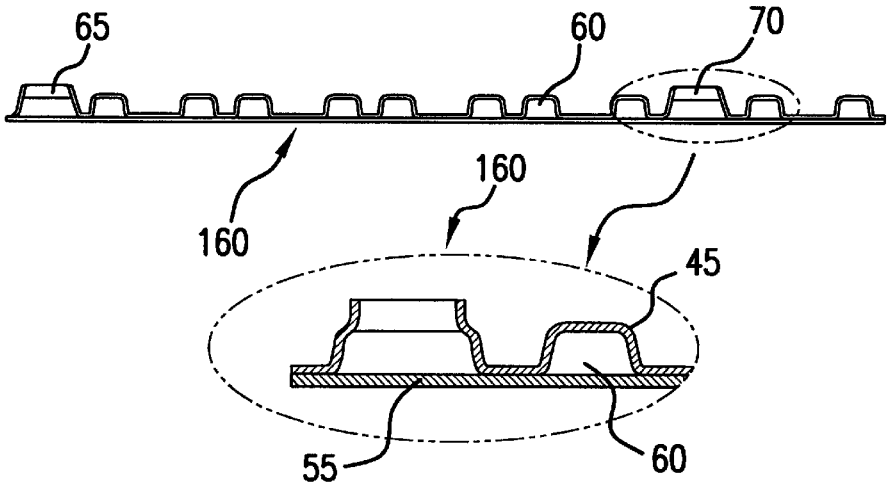
FIG. 2*b* is a side sectional view of the evaporation plate according to the primary embodiment of this invention.
Figure 3:
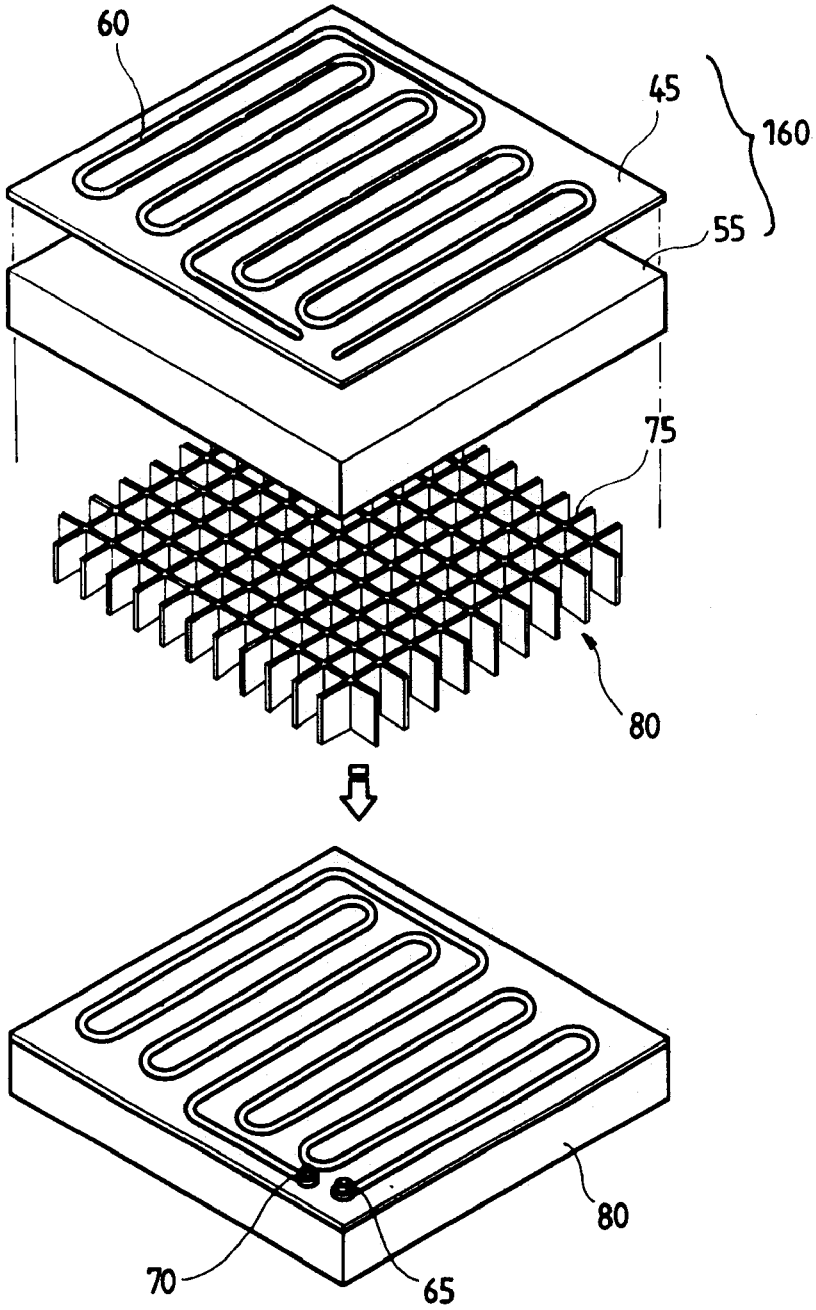
FIG. 3 is a perspective view, showing the construction of an evaporation plate for ice making machines in accordance with the second embodiment of the present invention.
Figure 4:
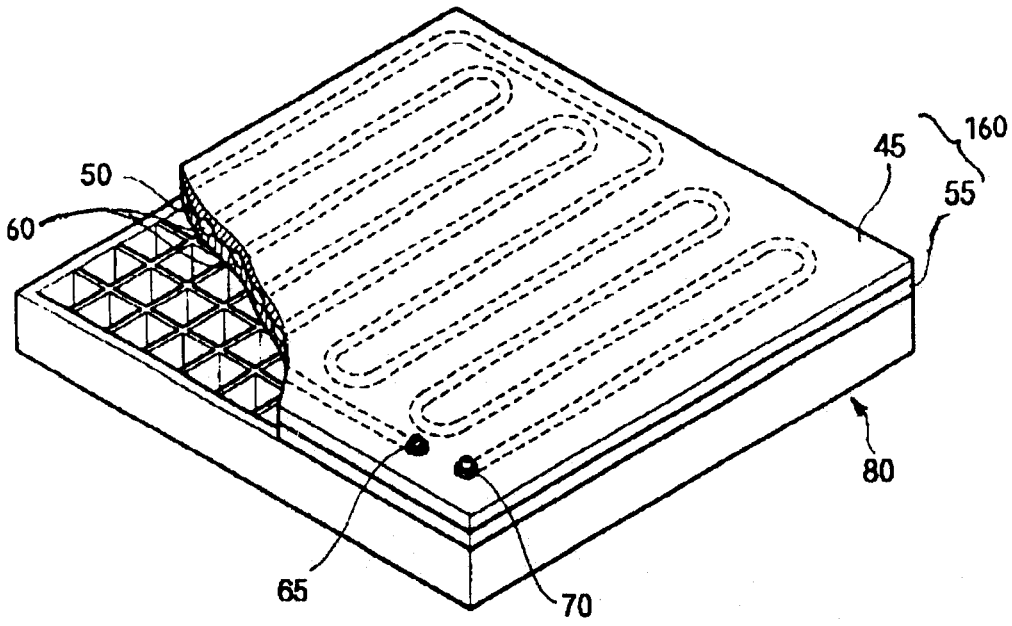
FIG. 4 is a partially broken perspective view of an evaporation plate for ice making machines in accordance with the third embodiment of the present invention.
Figure 5:
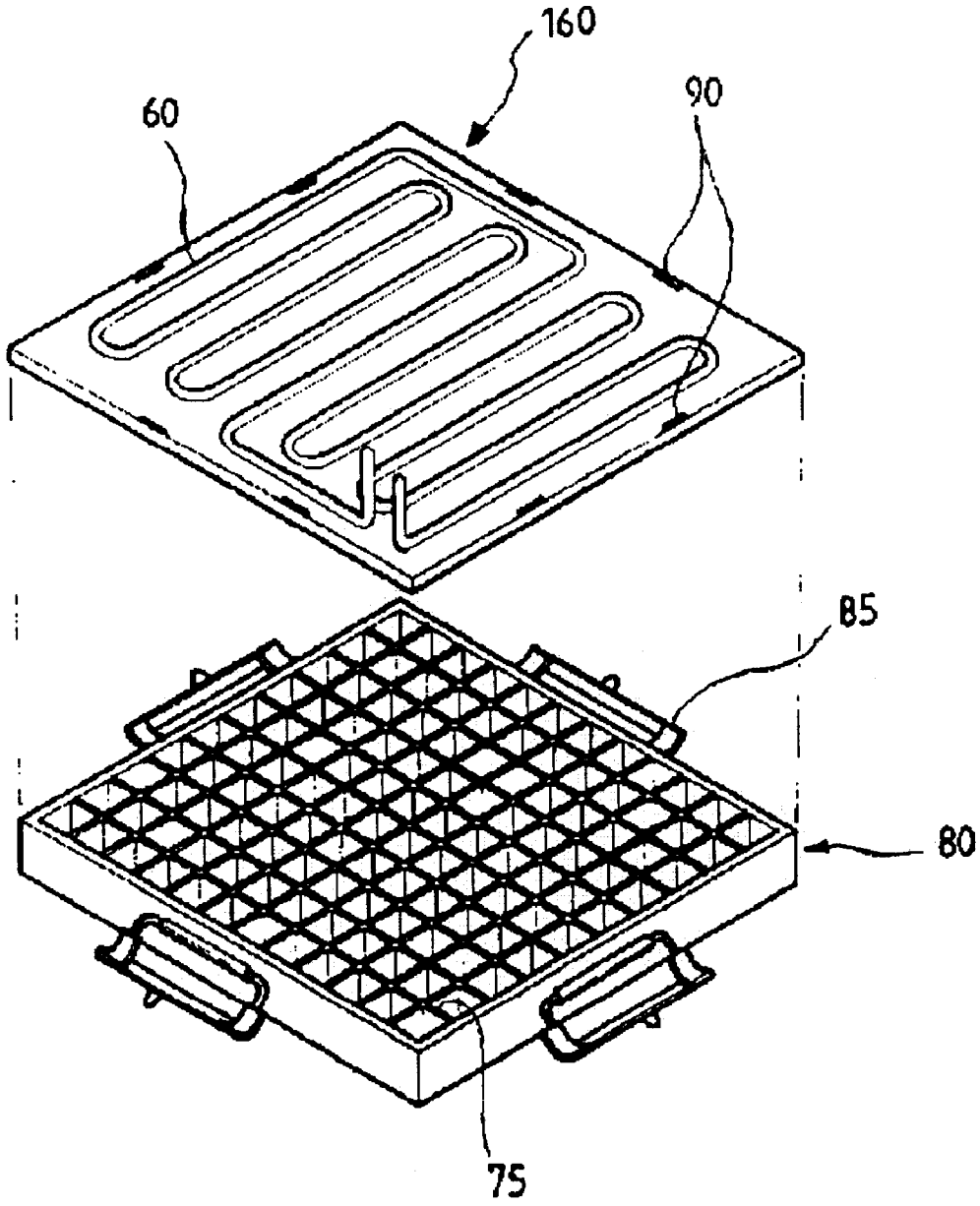
FIG. 5 is a perspective view of an evaporation plate for ice making machines in accordance with the fourth embodiment of the present invention, the evaporation plate having a structure detachably assembled with an ice making cell plate.

FIG. 2*a* is a plan view of an evaporation plate for ice making machines in accordance with the primary embodiment of the present invention. FIG. 2*b* is a side sectional view of the evaporation plate of FIG. 2*a*. FIG. 3 is a perspective view, showing the construction of an evaporation plate for ice making machines in accordance with the second embodiment of this invention. FIG. 4 is a partially broken perspective view of an evaporation plate for ice making machines in accordance with the third embodiment of this invention. FIG. 5 is a perspective view of an evaporation plate for ice making machines in accordance with the fourth embodiment of the present invention, the evaporation plate having a structure detachably assembled with an ice making cell plate.

As shown in FIGS. 2*a* and 2*b*, the evaporation plate 160 for ice making machines according to the primary embodiment of this invention comprises an upper panel 45, with a desired refrigerant channel formed on the panel 45 through a pressing process. A flat lower panel 55, free from any refrigerant channel, is integrated with the upper panel 45 through a compression bonding process into a single plate having a desired refrigerant passage therein.

In the evaporation plate 160, the refrigerant channel formed on the upper panel 45 has a serpentine shape suitable for effectively enlarging the contact area at which the cold liquid refrigerant comes into contact with the wall of the evaporation plate 160 while flowing in the plate 160.

On the other hand, the lower panel 55 is a flat panel through which the cold liquid refrigerant absorbs heat from water positioned outside the panel 45 so as to freeze the water to make ice. Typically, an ice making cell plate is mounted to the lower surface of the lower panel 55.

Each of the upper and lower panels 45 and 55 is preferably made of a material having high heat conductivity and high resistance against corrosion.

On the other hand, refrigerant inlet and output ports are respectively formed at opposite ends of the refrigerant passage of the evaporation plate 160, with two fitting members 65 and 70 being respectively set within the inlet and outlet ports and allowing the ports to be connected to refrigerant pipes, with one pipe extending to a compressor and the other pipe extending from a capillary tube.

In the evaporation plate 160 according to the second embodiment of FIG. 3, the upper and lower panels 45 and 55 are integrated into a desired single plate through a thermo-compression bonding process, with an adhesive 50 being applied to the junction of the two panels 45 and 55. This evaporation plate 160 has a refrigerant passage 60 therein and is flat at opposite surfaces thereof, thus having a good appearance.

In the above evaporation plate 160, the upper and lower plates 45 and 55 are flat at their first surfaces and are formed with refrigerant channels at their second surfaces through a pressing process. The two panels 45 and 55 are integrated into the desired single plate, with the adhesive 50 applied to the junction of the two panels 45 and 55, in a way such that the refrigerant channels of the two panels 45 and 55 define the desired refrigerant passage 60 within a resulting evaporation plate and the flat surfaces of the two panels 45 and 55 from opposite surfaces of the evaporation plate. In such a case, the upper and lower panels 45 and 55 are made of the same material having high thermal conductivity and high resistance against corrosion.

As shown in FIG. 4, the evaporation plate 160 according to the third embodiment comprises upper and lower panels 45 and 55, which are flat at their first surfaces and are formed with refrigerant channels at their second surfaces and are integrated into a desired single plate in a way such that the refrigerant channels of the two panels 45 and 55 define a desired refrigerant passage 60 within the resulting evaporation plate 160 and the flat surfaces of the two panels 45 and 55 from opposite surfaces of the evaporation plate 160. This evaporation plate 160 may be integrated with an ice making cell plate 80 at either surface thereof since the opposite surfaces of the plate 160 are flat as described above. That is, the ice making cell plate 80 may be mounted to the upper panel 45 or the lower panel 55 of the evaporation plate 160. In such a case, the ice making cell plate 80 may have a variety of cells 75 agreeing with the desired sizes and shapes of desired ice cubes.

That is, the ice making cell plate 80 is provided with a plurality of cells 75 having a variety of sizes and shapes, thus producing ice cubes having a variety of sizes and shapes determined by the sizes and shapes of the cells 75. The above ice making cell plate 80 is preferably made of a material having high heat conductivity and is integrated with the evaporation plate 160 into a single body through a welding process.

On the other hand, the evaporation plate 160 according to the third embodiment has refrigerant inlet and output ports at opposite ends of the refrigerant passage 60, with two fitting members 65 and 70 being respectively set within the inlet and outlet ports and allowing the ports to be connected to refrigerant pipes, with one pipe extending to a compressor and the other pipe extending from a capillary tube. Of course, it should be understood that the refrigerant pipes may be directly welded to the refrigerant inlet and outlets ports of the passage 60 without using such fitting members 65 and 70.

In the embodiments of FIGS. 3 and 4, it is preferable to use an adhesive, having a melting point lower than that of the upper panel 45 of the evaporation plate 160 and being free from reacting with the refrigerant, as the adhesive 50.

In the present invention, it is preferable to firmly mount the evaporation plate 160, having an ice making plate, within an ice making machine through a welding process. In addition, it should be understood that the shape and dimensions of the serpentine refrigerant passage 60 may be somewhat freely designed to agree with desired operational conditions of the ice making machine. The fitting members 65 and 70 have a shape capable of being easily and closely fitted into and welded to the inlet and outlet ports of the refrigerant passage 60.

As shown in FIG. 5, the evaporation plate 160 according to the fourth embodiment is designed in that it is detachably assembled with a desired one of a variety of ice making cell plates 80 different from the afore-mentioned embodiments of which the ice making cell plate 80 is welded to the evaporation plate 160.

That is, the evaporation plate 160 according to the fourth embodiment has two locking notches 90 at each side edge thereof, while the ice making cell plate 80 has a plurality of clamps 85 at positions corresponding to the notches 90 of the evaporation plate 160 and is detachably assembled with the evaporation plate 160 by clamping the clamps 85 to the notches 90 in a conventional manner.

Since the evaporation plate 160 according to the fourth embodiment has a structure capable of being detachably assembled with a variety of ice making cell plates 80, it is possible to selectively mount a desired ice making cell plate 80 to the evaporation plate 160. This finally allows the evaporation plate 160 to be usable in making ice cubes having a variety of sizes and shapes.

As described above, the present invention provides an evaporation plate for ice making machines. This evaporation plate has a desired serpentine evaporation passage formed by an integration of two panels into a single plate, thus being free from a conventional separate serpentine evaporation tube. This is, the evaporation plate according to the invention comprises an upper panel having a desired refrigerant channel formed on the panel through a pressing process. A flat lower panel, free from a refrigerant channel, is integrated with the upper panel through a thermocompression bonding process into a single plate having a desired refrigerant passage therein formed by the channel. This evaporation plate improves heat conductivity of refrigerant to a desired high level and is almost completely free from leakage of refrigerant since the two panels are firmly integrated into a single plate without leaving any gap at the junction between the two panels. Since the evaporation plate of this invention is free from a conventional separate serpentine evaporation tube, the evaporation plate has a simple construction and is automatically produced in commercial quantity at low production cost.

Although a preferred embodiment of the present invention has been described for illustrative purposes, those skilled in the art will appreciate that various modifications, additions and substitutions are possible, without departing from the scope and spirit of the invention as disclosed in the accompanying claims.

What is claimed is:

1. An evaporation plate for ice making machines, comprising:

an evaporation plate produced by a compression bonding process with an upper panel having a refrigerant channel and a flat lower panel free from any refrigerant channel;

a fitting member being set within each of refrigerant inlet and outlet ports formed at said evaporation plate;

a locking notch formed on each side edge of said evaporation plate;

clamps being able to clamp to said notch;

an ice making cell plate, connected with said clamps, having a plurality of cells producing ice cubes by refrigerant flowing in said refrigerant channel.

2. The evaporation plate according to claim 1, wherein said upper and lower panels are integrated into the desired single plate through a thermocompression bonding process, with an adhesive being applied to a junction between the two panels.

3. The evaporation plate according to claim 1, wherein said upper and lower plates are flat at their first surfaces and are formed with refrigerant channels at their second surfaces, and are integrated into the desired single plate in a way such that the refrigerant channels of the two panels define the desired refrigerant passage and the flat surfaces of the two panels form opposite surfaces of the single plate.

4. The evaporation plate according to any one of claims 1, 2 and 3, wherein an ice making cell plate having a plurality of cells are welded to either said upper or lower panel into a single structure.

* * * * *